United States Patent [19]

Bomford et al.

[11] 4,101,712

[45] Jul. 18, 1978

[54] METHOD OF PRODUCING A MATERIAL WITH LOCALLY DIFFERENT PROPERTIES AND APPLICATIONS OF THE METHOD

[75] Inventors: Michael J. Bomford, Clehonger, England; Gernot Gessinger, Bublikon, Switzerland

[73] Assignee: BBC Brown Boveri & Company Limited, Baden, Switzerland

[21] Appl. No.: 637,060

[22] Filed: Dec. 2, 1975

[30] Foreign Application Priority Data

Dec. 23, 1974 [CH] Switzerland ..... 17239/74

[51] Int. Cl.[2] ..... B22F 1/00; B22F 3/16; B22F 5/04

[52] U.S. Cl. ..... 428/547; 27/156.8 B; 75/211; 75/246; 416/223 R

[58] Field of Search ..... 75/208 R, 211, 246; 29/182.5, 156.8 B; 428/547; 416/223

[56] References Cited

U.S. PATENT DOCUMENTS

| | | | |
|---|---|---|---|
| 3,148,981 | 9/1964 | Ryshkewitch | 75/208 R X |
| 3,305,923 | 2/1967 | Zimmer | 75/208 R X |
| 3,359,622 | 12/1967 | Meyer et al. | 75/208 R X |
| 3,940,268 | 2/1976 | Catlin | 75/208 R |

*Primary Examiner*—Richard E. Schafer
*Attorney, Agent, or Firm*—Oblon, Fisher, Spivak, McClelland & Maier

[57] ABSTRACT

A method of producing a material with locally different properties comprises filling a form with at least two different component powders such that the ratio of contents of said powders in the mixture continuously varies over at least some spatial extent, compacting the mixed powders in the form, and subsequently sintering the compacted powders.

6 Claims, 3 Drawing Figures

METHOD OF PRODUCING A MATERIAL WITH LOCALLY DIFFERENT PROPERTIES AND APPLICATIONS OF THE METHOD

BACKGROUND OF THE INVENTION

1. Field of the Invention

This invention concerns a method of producing a material with locally different properties as well as applications of the method.

2. Description of the Prior Art

It is known to effect changes in material properties within small dimensions of the order of a millimeter by application of a diffusion layer to an underlayer consisting of a different material. Large changes in properties occur at the boundary surface of the composite structures.

It is also known to form discontinuous transitions of properties over dimensions which are in the macroscopic range by contacting different materials.

However, it is often desired to have different chemical, physical and/or mechanical properties within the volume of a solid body. When this is attempted by means of composite structures, the resultant products always exhibit sharp interfaces and attendant abrupt property changes. The use of diffusion annealing is time consuming, limited to relatively short sections and applicable to only a small number of material combinations. Consequently, there continues to exist a need for an improved method of forming a material with continuously, locally differing properties.

SUMMARY OF THE INVENTION

Accordingly, it is an object of this invention to provide a method for preparing a material having continuously changing properties over rather large cross sections.

Briefly, this and other objects of this invention as will hereinafter become clear from the ensuing discussion have been attained by providing a method which comprises filling a form with at least two different component powders such that the ratio of contents of said powders in the mixture continuously varies over at least some spatial extent, compacting the mixed powders in the form, and subsequently sintering the compacted powders, i.e., filling a form with powders of varying composition such that the composition of the powder at different locations in the form corresponds to the desired material composition at those locations in the finished material, compressing the powder in the form, and finally sintering the compressed powder.

It is advantageous to supply each of the powdered components to be intermixed by means of conveyer- and proportioning screws which deliver the desired mixture ratio to a mixing device, preferably a mixing screw, and then to deposit the mixed powder into the form.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views and wherein.

DESCRIPTION OF THE PREFERRED EMBODIMENTS

Figure 1:
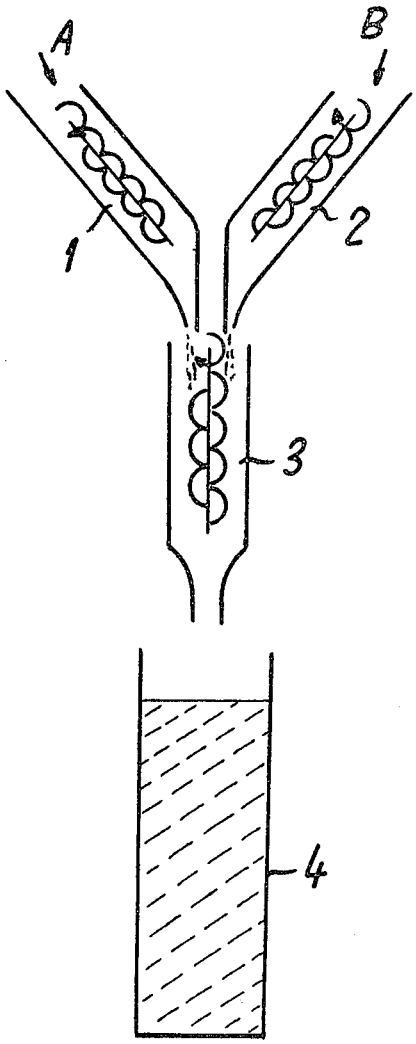
FIG. 1 shows schematically an arrangement for carrying out the method of this invention.
Figure 2:
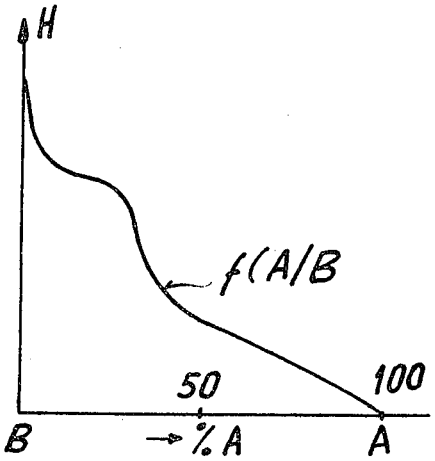
FIG. 2 shows the distribution function plotted against height in the form.

As can be seen in FIG. 1, by means of the schematically represented apparatus a powder A and a powder B are each delivered by a conveyer— and proportioning screws 1 and 2, respectively, to a mixing device 3, from which they are poured into the form 4 after being well blended by the mixing screw. By varying the rate of rotation of the two conveyor — proportioning screws 1 and 2 the mixture ratio of the two powders A and B can be adjusted as desired and/or varied continuously. The ratio may vary from 100% of one component to 100% of the other or may vary from any selected ratio to any other selected ratio. The variation may be monotonic or not. The determination of the appropriate ratios and variation in ratios is based upon the desired values and variation thereof of the properties in the final product.

In the illustrated embodiment, the form 4 is filled with the two powders in such a way that first only powder A and then a continually increasing proportion of powder B is introduced, until finally only powder B is still being added. Thus, there is obtained a gradient, from 100% powder B to 100% powder A, whose magnitude can be varied as desired. Obviously, still other components can be introduced in any desired concentrations and distributions. One need only employ additional delivering means such as the conveyor - and proportioning — screws shown in FIG. 1.

The powder in the form 4 is then compressed by known methods, e.g., by isostatic pressing or hot-extrusion pressing. The particular means employed can be easily determined by conventional consideration of factors such as the properties of the component powders. It is further possible, by subsequent treatment steps to enhance the property distribution even more, e.g., by thermomechanical aftertreatment such as any combinations of pressure and temperature which induce controlled differences in the matrix, such as differences in grain size, texture or porosity. Forms suitable for use in this invention include those conventionally used for compacting and sintering alloys. The form should be suitable for performance of any desired aftertreatment on the powder mix and typically is evacuable.

Embodiments of applications in which the above-described general method can be effectively utilized are described below for purposes of illustration only and are not intended to be limiting unless otherwise specified.

It is known that during operation of a gas turbine a temperature drop of several hundred degrees Centigrade is developed between the tip of a turbine blade and its foot. Mechanical strength is the chief requirement of a turbine blade foot, while resistance to extreme corrosive attack is a primary requisite of a blade tip. Although dispersion-hardened super-alloys, as for example, IN-853 (0.05 wt.-% C, 20.0 wt.-% Cr, 2.5 wt.-% Ti, 1.5 wt.-% Al, 0.007 wt.-% B, 0.07 wt.-% Zr, 1.3 wt.-% $Y_2O_3$, remainder Ni), exhibit high strength at temperatures in the region of 1000° C, i.e. would be suited for the blade tip, their strength at room and medium temperatures, which prevail at the blade foot, is clearly exceeded by conventional powder-metallurgical alloys, as for example IN-100 (0.18 wt.-% C, 10.0 wt.-% Cr, 15.0 wt.% Co, 3.0 wt.-% Mo, 4.7 wt.-% Ti, 5.5 ct.-% Al, 0.014 wt.-% B, 0.06 wt.-% Zr, 1.0 wt.-% V, remainder Ni). Thus, neither alloy is an optimal material for the entire blade. The application of the method of the present invention now makes it possible to use a dispersion free alloy for the portion of the turbine blade not subjected to high temperatures (the foot) and to replace it gradually towards the blade tip with a dispersion-hardened alloy. The requirements of chemical compatibility and the appropriations of the same thermomechanical aftertreatment for each alloy are satisfied by the use of the two Ni-base superalloys.

Figure 3:
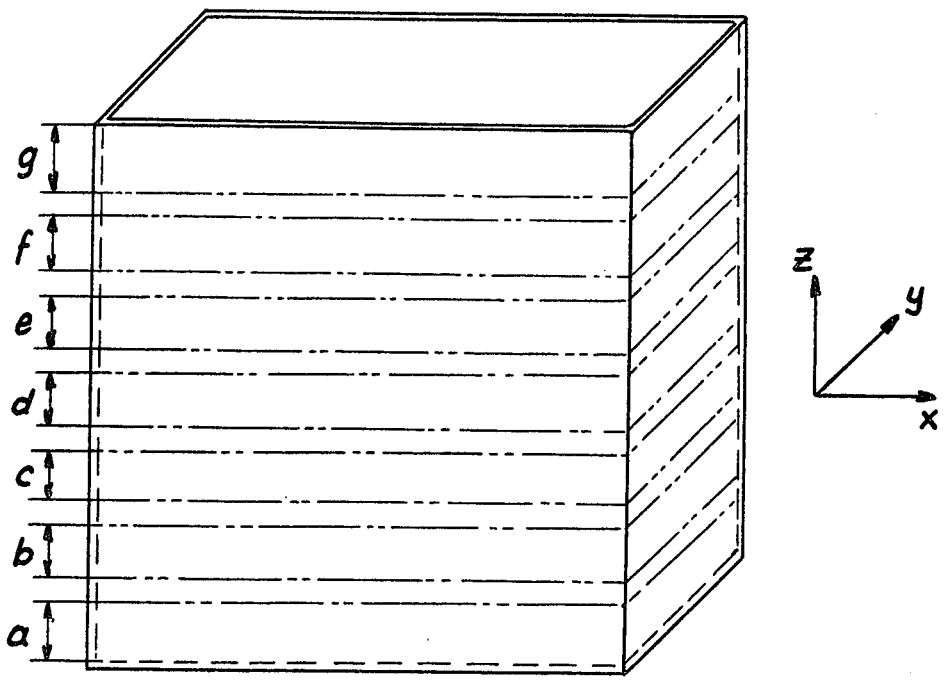
FIG. 3 shows an example of an application of the method of this invention.

The invention is explained in greater detail below with the help of FIG. 3. Consider a mixture of two alloy powders A and B, with A corresponding to the powder IN-100 and B to the powder IN-853. The powder A was conventionally produced by spraying it out of the melt in an argon protective atmosphere. Powder B was a composite powder obtained by the so-called mechanical alloying process by dry grinding in a mill [cf, e.g., J. S. Benjamin, Met. Trans. 1 (1970) 2943]. A sieve fraction $<100$ μm of the two powders was used. It is important to utilize about the same powder grain sizes, since otherwise, vibration could produce unmixing of the particles. For this example a rectangular container of stainless steel was used with a bottom area of 100 × 50 mm and a height of 100mm and was filled with successive layers by means of the device shown in FIG. 1 in such a way that, in continuous gradation from bottom to top, seven principal regions, *a* to *g*, were produced with the following mixture ratios between powder A and powder B going from bottom to top:

100% A, 80/20, 60/40, 50/50, 40/60, 20/80, 100% B. By subsequent vibration the density of the layers could be brought up to about 60% of the theoretical density. Finally the container is closed with a cover, preferably by electron beam welding, and evacuated.

The container full of powder was heated to 1100° C for two hours and then compressed to a density of 98% of the theoretical by forging. After cooling, the container was trimmed away and the specimen was again heated, this time to 1000° C, and held at this temperature for an hour. In a series of hot-rolling processes in the x-direction the specimen was reduced to a thickness of 10 mm. Finally the specimen, after being cut into small pieces along its length, was rolled down to a thickness of 5 mm normal to the original direction. Annealing at 950° C was necessary before each rolling. Finally, the specimen was annealed at 1275° C for two hours to produce grain growth in the dispersion alloy. From the specimen thus produced there were selected 8 tensile-test samples as follows:

(α) two from the *a* region (in *x*-direction),
(β) two from the *b* region (in *x*-direction),
(γ) two from the 50/50 region (in *x*-direction),
(δ) two in the Z-direction over the entire length.

Tensile strength tests at room temperature and at 950° C gave the following results:

| Region or Direction of Sample | Tensile Strength (kp/mm²) | Temperature of Sample (° C) |
|---|---|---|
| a | 162 | 20 |
| a | superplastic behavoir | 950 |
| 50/50 | 121 | 20 |
| 50/50 | 10.5 | 950 |
| b | 100.6 | 20 |
| b | 16 | 950 |

-continued

| Region or Direction of Sample | Tensile Strength (kp/mm²) | Temperature of Sample (° C) |
|---|---|---|
| Z(1) | 102.8 | 20 |
| Z(2) | superplastic behavior | 950 |

The Z(1) sample failed in the b-region, Z(2) in the a-region.

It is obviously also possible to make a specimen the spatial composition of which exhibits locally different oxidation behavior. For this, as a further example, likewise consider a mixture of two powder types, with the powder A corresponding to the above-mentioned powder type IN-100 and powder B having the following composition: 25% Cr, 4% Al, 1% Y, remainder Ni. Both powders were conventionally produced by atomization in an inert gas. Only the sieve fraction $<100$ μm was used. As in the previously described example, these powders were deposited in layers in a container, so that different layers were formed one over another by continuously varying the mixing ratios between A and B. After welding shut the evacuated container, the powder was heated to 1100° C and held at this temperature for two hours. Next the powder was compacted by forging. Thereafter, the mix was compacted to 10 mm thickness by hot-rolling in the *x*-direction. A 100 hour long oxidation test in still air and at a temperature of 1100° C resulted, for a sample from the 100% A-powder region, in a weight increase of 50 mg/cm³ and for a sample from the 100% B-powder region, in a weight increase of 0.6 mg/cm³.

In like fashion, the method of this invention can be used to prepare a substance which displays a spatial variation of any desired property by mixing two or more component substances which are suitably different from each other in the nature of this property.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method of producing a turbine blade with locally different properties, comprising:

filling a form with two different component powders such that the ratio of contents of said powders in the mixture continuously varies over the spatial extent of the form; wherein each of the powdered components to be mixed together is introduced in the desired proportion by a conveyer proportioning screw into another mixing screw and therefrom is deposited in the mixed state into said form; and wherein one of said powders is a high strength super-alloy and is the predominant ingredient of said mixture in the portion of the workpiece intended for the blade foot, and the other powder is a non-corrosive Co- or Ni-base alloy and is the predominant ingredient of said mixture in the portion of the workpiece intended for the blade tip, and the transition from one powder to the other along the length of the workpiece is continuous;

compacting the mixed powders in the form; and subsequently sintering the compacted powders.

2. The method of claim 1 wherein said high strength super alloy is IN 700 and said non-corrosive alloy consists essentially of 25% Cr, 4% Al, 1% Y, and balance Ni.

3. The method of claim 1, for producing a material for use in turbine blades wherein the powders which are the predominant ingredient of said mixture in the portion of the workpiece intended for the blade tip is a material having a higher heat- and creep-strength then is possessed by the powder which is the predominant ingredient of said mixture in the blade foot, and wherein said latter powder is a material having a greater toughness than said former powder and wherein the transition from predominance of the powder appropriate for the blade foot to the predominance of the powder appropriate for the blade tip is continuous along the workpiece being fabricated.

4. The method of claim 3 wherein said higher heat- and creep strength powder is made of alloy IN-853 and said higher toughness powder is made of alloy IN-100.

5. A turbine blade made by the method of claim 1.

6. A turbine blade made by the method of claim 3.

* * * * *